United States Patent [19]

Mannino

[11] Patent Number: 4,948,274

[45] Date of Patent: Aug. 14, 1990

[54] RIBBON FEED MECHANISM

[75] Inventor: Robert S. Mannino, Chatsworth, Calif.

[73] Assignee: Sercomp Corporation, Chatsworth, Calif.

[21] Appl. No.: 296,528

[22] Filed: Jan. 12, 1989

[51] Int. Cl.[5] ..... B41J 32/00

[52] U.S. Cl. ..... 400/196.1; 400/208

[58] Field of Search ..... 400/235.1, 196, 196.1, 400/208

[56] References Cited

U.S. PATENT DOCUMENTS

| | | | |
|---|---|---|---|
| 3,989,132 | 11/1976 | Carson, Jr. | 400/196.1 |
| 4,131,372 | 12/1978 | Hengelhaupt | 400/196.1 |
| 4,210,403 | 7/1980 | Mazouet et al. | 400/196.1 |
| 4,213,716 | 7/1980 | Carson, Jr. | 400/196.1 |
| 4,325,645 | 4/1982 | Miyajima et al. | 400/196.1 |
| 4,351,619 | 9/1982 | Duke et al. | 400/196.1 |
| 4,388,006 | 6/1983 | Waibel | 400/196 |
| 4,397,574 | 8/1983 | Wojdyla | 400/196.1 |
| 4,504,160 | 3/1985 | Payne et al. | 400/196.1 |
| 4,534,667 | 8/1985 | Bury | 400/196.1 |
| 4,568,209 | 2/1986 | Zerillo | 400/216.1 |
| 4,589,789 | 5/1986 | Quick et al. | 400/195 |
| 4,614,448 | 9/1986 | Suzaki et al. | 400/235.1 |
| 4,650,354 | 3/1987 | Morarka et al. | 400/196.1 |

FOREIGN PATENT DOCUMENTS

| | | | |
|---|---|---|---|
| 3530659 | 3/1987 | Fed. Rep. of Germany | 400/235.1 |
| 173190 | 10/1982 | Japan | 400/196.1 |
| 108185 | 6/1983 | Japan | 400/196.1 |
| 99689 | 6/1985 | Japan | 400/196.1 |

OTHER PUBLICATIONS

Self-Aligning Ribbon Stuffing Mechanism, IBM Technical Disclosure Bulletin, vol. 28, No. 9, pp. 3898-3899, Feb. 1986.

*Primary Examiner*—Eugene H. Eickholt

*Attorney, Agent, or Firm*—Poms, Smith, Lande & Rose

[57] ABSTRACT

An improved ribbon feed mechanism having idler and drive roller assemblies, each of which uses a single roller rotatably mounted on a retainer support featuring stripping portions which strip an inked ribbon off the rollers preventing the ribbon from wrapping around the rollers. The feed mechanism feeds the ribbon inside a cassette, cartridge or other container so that the ribbon may be stacked or folded in loops or folds inside the cartridge or container and used for computer printing, dot matrix printing, typewriter printing, or other printing operations. Each of the drive and idler assemblies uses a single roller attached to a shaft which may be removably and rotatably mounted to a retainer support. The single rollers are made out of foam material. The use of a single rather than multiple rollers for the roller assemblies facilities gripping of the ribbon passing between the rollers which results in increased pulling force needed for long ribbons.

17 Claims, 2 Drawing Sheets

10
12
14
16
18
20
22
24
26
28
30
34
36
38
52
54
56
58
68
70
78
80
82
84
88
90
92
94
96
98
100
110
II
II

Fig. 3.
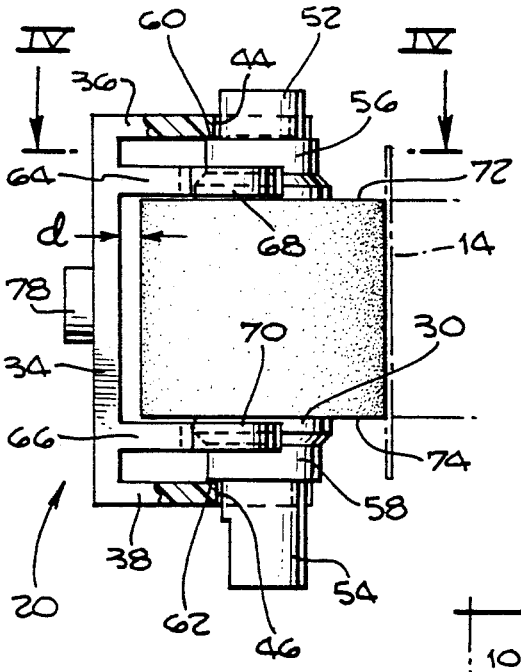
Fig. 5.
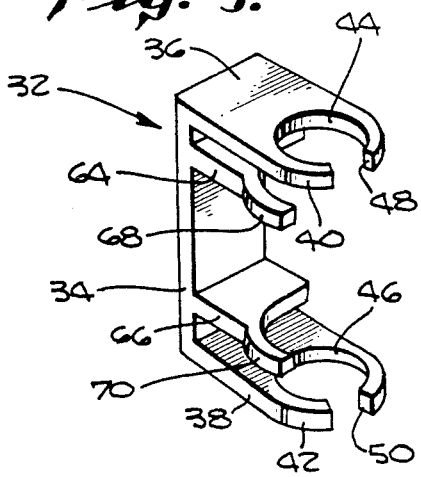
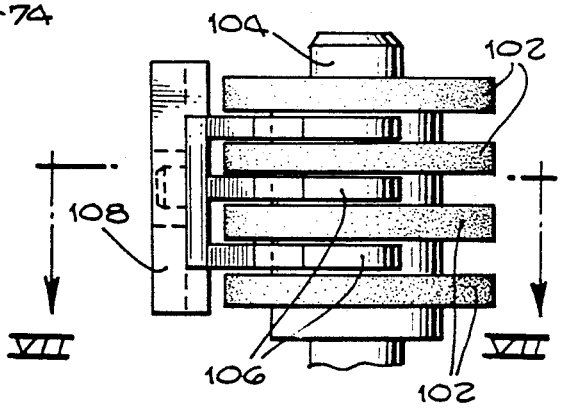
Fig. 6
PRIOR ART
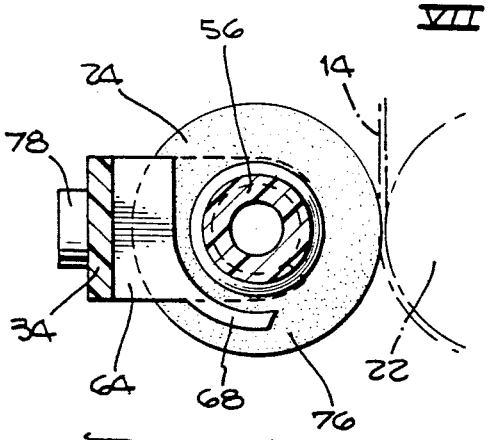
Fig. 4.
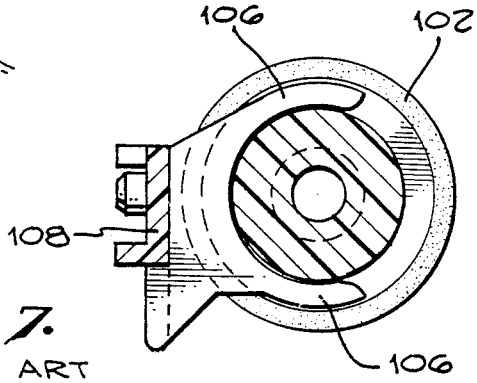
Fig. 7.
PRIOR ART

RIBBON FEED MECHANISM

BACKGROUND OF THE INVENTION

The present invention relates generally to ribbon feed mechanisms and, more particularly, to an improved ribbon feed mechanism having drive and idler roller assemblies, each of which uses a single roller rotatably mounted on a retainer support featuring stripping portions attached to the retainer support which strip an endless printing (inked) ribbon off the rollers. The ribbon is fan or randomly folded, or stacked in loops or folds inside a cassette, cartridge or container used for holding the ribbon to be used during computer printing, dot matrix printing, typewriter printing operations, or other printing operations.

In the past, ribbon feed mechanisms have been used to fold or stack a length of printing (inked) ribbon inside different cartridges or containers for the purpose of furnishing an endless length of ribbon which may be used for printing purposes. The ribbon is typically fed into a container or cartridge by the feed mechanism which causes the ribbon to fold or stack as loops inside the hollow container, leaves the container for printing, and then returns back inside the container, where it is once again folded or stacked.

A feed mechanism using rollers with teeth is disclosed in U.S. Pat. No. 4,534,667, issued to Bury on Aug. 13, 1985. Each drive and idler roller assembly used for the feed mechanism described in this patent uses two rollers. Ribbon stripping guides are shown attached to interior walls or webs of a cassette holding a plurality of ribbon folds. The guides are used to strip the ribbon from the rollers after it is fed into the cassette. U.S. Pat. No. 4,131,372, issued to Hengelhaupt on Dec. 26, 1978, describes an endless ribbon cassette used for typewriters. The cassette has a feed mechanism with knurled rollers and uses stripping fingers attached to the walls or webs of the cassette to prevent ribbon fed into the cassette from winding about the rollers. Stripping fingers formed as part of interior walls of a cassette are described in U.S. Pat. No. 4,351,619, issued to Duke, et al., on Sept. 28, 1982. The stripping fingers prevent a continuous ink ribbon fed into the cassette by a feed mechanism from wrapping around dual rubber rings or rollers attached to each roller assembly. Movable stripper rings are used for the ribbon stripping mechanism described in U.S. Pat. No. 4,213,716, issued to Carson, Jr. on July 22, 1980. Drive and idler wheels or rollers with meshing teeth are used in this patent to feed an inked ribbon into a cartridge. The movable rings move the ribbon away from the rollers. Dual rollers are used for each of the drive and idler roller assemblies. Finally, U.S. Pat. Nos. 3,989,132, issued to Carson, Jr. on Nov. 2, 1976; 4,568,209, issued to Zerillo on Feb. 4, 1986 (dot matrix printer); and 4,589,789, issued to Quick, et al., on May 20, 1986, disclose other ribbon feed mechanisms.

Other roller assemblies have been fabricated in the past which use a plurality of rollers for each one of the drive and idler assemblies. The rollers are typically attached to a shaft or axial-like member and rotate with the shaft. A plurality of finger strippers have been used with the rollers. The finger strippers are attached to a support mounted inside a cassette, cartridge or container. The strippers fit between the rollers and are used to strip from the rollers a printing ribbon being fed into the cassette, cartridge or container. However, such roller assemblies are expensive to fabricate and do not always grip a printing ribbon with sufficient clamping force to provide the pulling force needed for long ribbons.

SUMMARY OF THE INVENTION

It is an object of this invention to provide an improved ribbon feed mechanism.

It is another object of this invention to provide an improved ribbon feed mechanism which has an improved means for stripping an endless printing ribbon from rollers used for drive and idler roller assemblies in a cartridge, cassette, or other container used to hold folded or stacked loops of the ribbon.

It is still another object of this invention to provide an improved ribbon feed mechanism which has a simplified design that uses only one roller for each of the drive and idler roller assemblies.

It is still another object of this invention to provide an improved ribbon feed mechanism that provides sufficient clamping force to furnish the pulling force needed for long ribbons.

It is still another object of this invention to provide an improved ribbon feed mechanism having drive and idler assembles that may be easily mounted inside a cassette, cartridge, or other container used for holding an endless printing ribbon, or may be easily removed from the cassette, cartridge, or other container and replaced with another mechanism, if desired, or repaired.

It is still another object of this invention to provide an improved ribbon feed mechanism that may be used inside cassettes, cartridges, or other containers needed for computer printing, dot matrix printing, typewriter printing operations, or other printing operations.

It is still another object of this invention to provide an improved ribbon feed mechanism that is economical to manufacture.

These and other objects and advantages are attained by an improved ribbon feed mechanism having idler and drive roller assemblies, each of which uses a single roller rotatably mounted on a retainer support featuring stripping portions which strip an inked ribbon off the rollers preventing the ribbon from wrapping around the rollers. The feed mechanism feeds the ribbon inside a cassette, cartridge or other container so that the ribbon may be stacked or folded in loops inside the cassette, cartridge, container and used for computer printing, dot matrix printing, typewriter printing, or other printing operations. Each of the drive and idler assemblies uses a single roller attached to a shaft which may be removably and rotatably mounted to a retainer support. The single rollers are made out of foam material. The use of a single roller rather than multiple rollers for the roller assemblies facilities gripping of the ribbon passing between the rollers which results in increased pulling force needed for long ribbons.

In accordance with a feature of the invention, each roller used for the drive and idler assembles is slightly shorter than the width of the ribbon, and horizontal stripping portions of the retainer support above and below the roller, as well as a vertical portion of the retainer support immediately adjacent the roller, block the path of the ribbon so that the outer edges of the ribbon engage the stripping portions and the vertical portion causing the ribbon to be stripped from the roller and preventing the ribbon from wrapping around the roller. In one preferred embodiment, the stripping portions are formed as an integral part of the retainer support, and the vertical portion of the retainer support, together with the stripping portions provide the resistance which reverses the direction of the ribbon and starts a fan-folding action.

The various features of the present invention will be best understood together with further objects and advantages by reference to the following description of the preferred embodiment taken in conjunction with the accompanying drawings.

BRIEF DESCRIPTION OF THE DRAWINGS

FIG. 3 is an enlarged, detailed elevational view of an idler roller assembly of the improved ribbon feed mechanism of FIG. 1;

FIG. 4 is a cross-sectional view taken in the direction of arrows IV—IV shown in FIG. 3;

FIG. 5 is a perspective view of a retainer support of the improved ribbon feed mechanism of FIG. 1;

FIG. 6 is an enlarged, detailed elevational view of a prior art roller assembly using four rollers attached to a shaft and stripping fingers which fit between the rollers; and FIG. 7 is a cross-sectional view taken in the direction of arrows VII—VII shown in FIG. 6.

DESCRIPTION OF THE PREFERRED EMBODIMENT

Figures 1, 2:
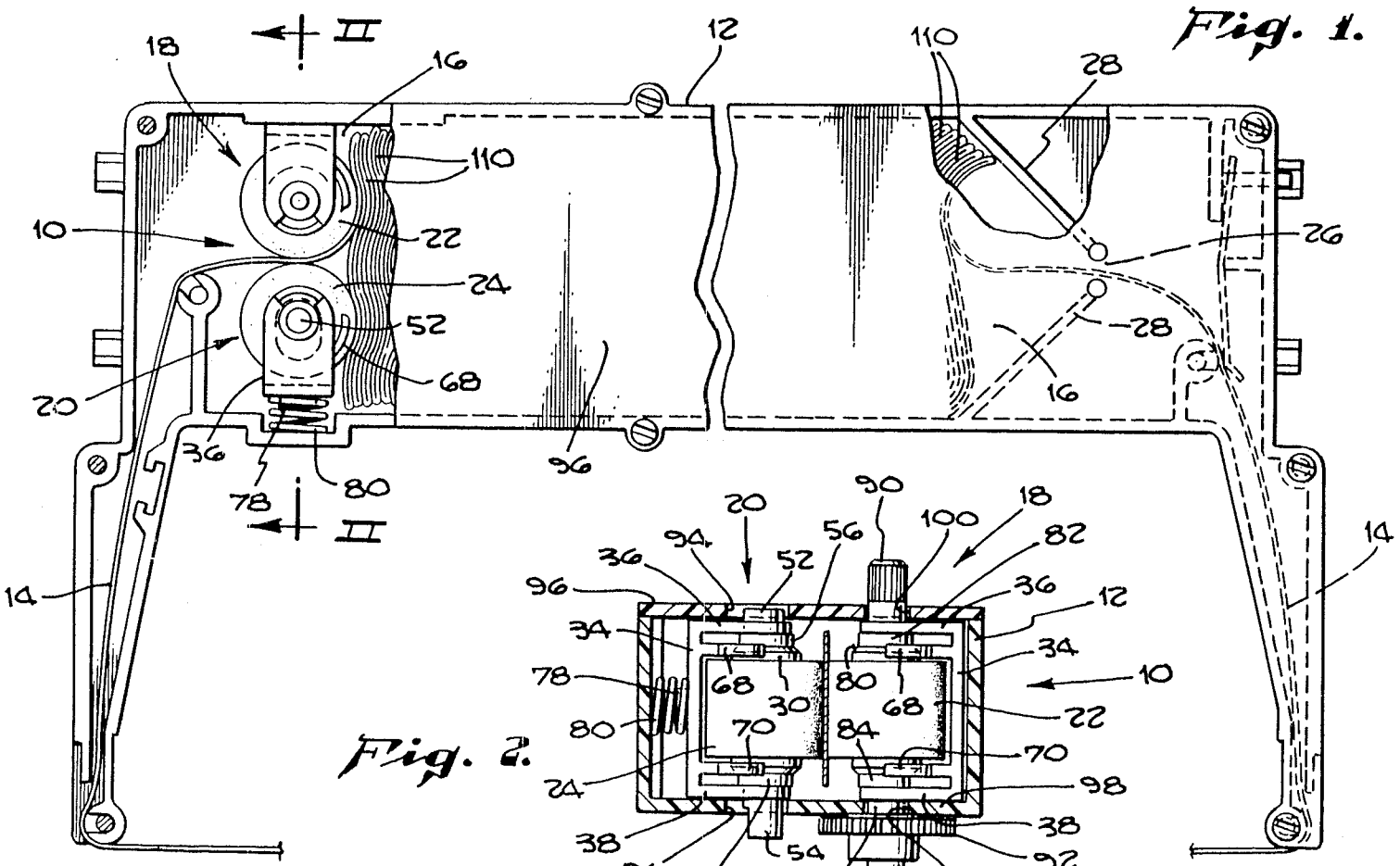
FIG. 1 is a top plan vieW of a cassette with part of the cover of the cassette broken away to reveal an improved ribbon feed mechanism illustrating the principles of the present invention showing how the mechanism is used to stack or fold an endless printing ribbon inside the cassette.
FIG. 2 is a cross-sectional view taken in the direction of arrows II—II shown on FIG. 1.

The following specification taken in conjunction with the drawings sets forth the preferred embodiment of the present invention in such a manner that any person skilled in the art can make and use the invention. The embodiment of the invention disclosed herein is the best mode contemplated by the inventor for carrying out his invention in a commercial environment, although it should be understood that various modification can be accomplished within the parameters of the present invention.

FIGS. 1 and 2 show an improved ribbon feed mechanism 10 of the present invention mounted inside a cassette 12 for the purpose of feeding an endless printing (inked) ribbon 14 into the cassette 12 so that the ribbon 14 is fan-folded or stacked in loops or folds 110 inside the hollow storage space 16 of the cassette 12. The feed mechanism 10 has drive and idler roller assemblies 18 and 20, respectively, mounted inside the cassette 12 as shown in FIG. 2.

The ribbon 14 passes between rollers 22 and 24 of assemblies 18 and 20, respectively, and is fed into storage space 16 by the rotation of the rollers. As explained in the following discussion, the rollers 22 and 24 grip the ribbon 14 and pull on it causing the ribbon 14 to leave the storage space 16 at exit port 26 with webs 28 acting as guides for the ribbon, or move the ribbon for printing. As such, the ribbon 14 provides one continuous length of ribbon that moves into and out of space 16 as the rollers 22 and 24 feed it into storage space 16 while simultaneously pulling it out of space 16 at exit port 26 during printing operations.

It is important to note that the feed mechanism 10 may be used for any cassette, cartridge, or container. In addition, feed mechanism 10 may be used with any cassette, cartridge, or container used for computer printing, dot matrix printing, typewriter printing, or other type printing. The present invention is not intended to be limited to any particular type of printing or container used to hold the ribbon.

The idler roller assembly 20 is best shown in FIGS. 2, 3 and 4. Wheel 24 is attached to axle or shaft 30 and rotates with the shaft 30 which, in turn, is rotatably mounted on a retainer support 32. The retainer support 32 has a vertical portion 34 which has upper and lower horizontal portions 66 and 38, respectively, each extending horizontally at a substantially right angle from portion 34. Slotted, expandable rings 40 and 42 are formed at the ends of upper and lower portions 36 and 38. The expandable rings 40 and 42 have internal diameters 44 and 46, respectively, and openings or slots 48 and 50, respectively, therein. The slots 48 and 50 and diameters 44 and 46 are sized so that the rings 40 and 42 are able to expand to allow upper and lower extensions 52 and 54, respectively, of the shaft 30 to be pushed past the slots until the shaft 30 is rotatably mounted on the retainer support 34. As a result, the shaft 30 and roller 24 may be easily removed from the retainer support 20 and replaced with another roller and shaft. Note that shaft 30 also has upper and lower hub portions 56 and 58, respectively, of larger diameter than extensions 52 and 54 and larger than diameters 44 and 46, forming annular ledges 60 and 62 which keep shaft 30 from moving vertically. As such, roller 24 is free to rotate with shaft 30 when the shaft is rotatably mounted on the retainer support 34.

Two stripping portions 64 and 66 extend horizontally from vertical portion 34. Portions 64 and 66 have curved stripping guides 68 and 70, respectively, extending therefrom. The stripping portions 64 and 66 are located above and below the top and bottom surfaces 72 and 74, respectively, of the roller 24. Also, as shown in FIG. 4, the stripping guides 68 and 70 are located between the outside diameter 76 of the roller 24 and the hub portions 56 and 58. In addition, diameter 76 of the roller 24 is positioned a distance "d" from vertical support 34. As explained in the following discussion, the distance "d" is preferably about 0.05 inches. Also, the retainer support 32 has a projection 78 extending horizontally therefrom. Preferably, portions 34 through 38, 64 and 66 and projection 78 are formed or molded as integral parts of retainer support 32.

The drive roller assembly 18 also uses a retainer support 32 as shown in FIG. 2. Assembly 18 has a shaft 80 that is comparable with shaft 30, hub portions 82 and 84 like hub portions 56 and 58, and upper and lower extensions 86 and 88, respectively, like extensions 52 and 54. A turning knob 90 is attached to upper extension 86 and a gear 92 is attached to lower extension 88. Roller 22 is attached to shaft 80 and rotates with the shaft. The upper and lower portions 86 and 88 of the shaft 80 engage rings 40 and 42 of the retaining support 32. As a result, the shaft 90 and roller 22 are rotatably mounted on the retainer support 32.

Referring again to FIG. 2, upper and lower extensions 52 and 54 of the idler roller assembly 20 engage elongated apertures 94 in the top and bottom covers 96 and 98, respectively, of the cassette 12 when the assembly 20 is mounted inside the cassette 12 with lower horizontal portion 38 of the retainer support 32 resting on bottom cover 98. A spring 80 having one end against the side of the cassette 12 and the other end around projection 78 of the retainer support 32 biases or forces roller 24 against roller 22 as extensions 52 and 54 are free to move in elongated apertures 94 under the force of the spring 80.

The drive roller assembly 18 is held in place within the cassette 12 by extensions 86 and 88 which engage apertures 100 in the top and bottom covers 96 and 98. Note that the retainer support 32 used for assembly 18 does not have projection 78 and fits up against the side of the cassette 12 as shown in FIG. 2. The knob 90 may be used to initially feed the ribbon between rollers 22 and 24 and gear 92 is used to drive or rotate shaft 80 of the drive roller assembly 18 or roller 22, using a conventional power source, which also causes roller 24 to rotate since roller 24 is held against roller 22 by spring 80 and the ribbon 14 is sandwiched between the two rollers 22 and 24.

A prior art roller assembly is shown in FIGS. 6 and 7. The assembly has a number of rollers 102 attached to a shaft 104. Stripping fingers 106, attached to a support 108, mounted to a cassette, cartridge, or container, fit between the rollers 102 as shown. The stripping fingers 106 are used to prevent a printing ribbon (not shown) from wrapping around the rollers 102. Such roller assemblies are expensive to fabricate. In addition, a plurality of relatively thin rollers 102 often do not grip a ribbon hard enough to provide sufficient pulling force in the case of long ribbons.

The improved ribbon feed mechanism 10 of the present invention solves these problems. The use of a single roller 22 or 24 for the idler and drive roller assemblies 18 and 20 of the feed mechanism 10 simplifies the design of such assemblies making it more economical to manufacture such assemblies. In addition, a single roller 22 or 24 provides more surface area for the purpose of gripping a ribbon passing between two rollers, thus providing greater pulling force that is needed in the case of long ribbons. The rollers 22 and 24 are preferably made out of a urethane foam material composition of polyester or polyether. The cell structures of the material are to be open with 90 percent reticulation and all surfaces are to be smooth without irregularities that close cell construction. However, any suitable material may be used for the rollers 22 and 24.

The present invention also provides an improved means for stripping the ribbon 14 from the rollers 22 and 24, preventing the ribbon from wrapping around the rollers. As shown in FIGS. 2 and 3, the rollers 22 and 24 are sized so that the ribbon 14 extends above top surface 72 of roller 24 and below bottom surface 74 of roller 24. As a result, the edges or portions of the ribbon 14 that extend above and below the roller 24 come into contact with stripping portions 64 and 66 and vertical portion 34 of the retainer support 32 which cause the ribbon to be stripped from the roller 24 or prevent it from wrapping around the roller 24. The curved stripping guides 68 and 70 help to guide the edges of the ribbon 14 toward stripping portions 64 and 66 and vertical support 34, and guide any edges of the ribbon 14 bent over surfaces 72 and 74 of the rollers 22 and 24 toward portions 64 and 66 and support 34. The clearance "d" between the roller 24 and vertical support 34 is preferably about 0.05 inches which prevents the ribbon from trying to pass between the roller 24 and support 34 or from getting jammed in this area which would prevent the ribbon 14 from reversing itself and forming folds 110 inside the hollow storage space 16 of the cassette 12. The ribbon is stripped off roller 22 in the same way that it is stripped off roller 24 because the same retainer support 32 is used for both rollers.

Since the ribbon 12 will be stripped free of the rollers 22 and 24, ribbon 14 fed into the cassette 12 will form folds 110 as shown in FIG. 1. As such, the vertical support 34 together with the stripping portions 64 and 66 provide the resistance necessary to strip the ribbon from the rollers 22 and 24 and to reverse the direction of the ribbon which starts a fan-folding action, causing folds 110 to form in hollow space 16. Also, the ribbon 14 will be subjected to more pulling force because single rollers 22 and 24 are used for the drive and idler roller assemblies 18 and 20.

The above description discloses the preferred embodiment of the present invention. However, persons of ordinary skill in the art are capable of numerous modifications once taught these principles such as, by way of example and not limitation, materials other than foam material may be used for the rollers 22 and 24, or rollers with teeth may be substituted for foam rollers. Also, slotted, expandable rings 40 may be replaced by simple apertures so that each roller-shaft assembly is permanently attached or mounted to the retainer support and cannot be removed from the support. Accordingly, it will be understood by those skilled in the art that changes in form and details may be made to the above-described embodiment without departing from the spirit and scope of the invention.

I claim:

1. An improved ribbon feed mechanism used to fold a printing ribbon inside a cartridge-type container and to move the ribbon for printing, comprising:

a first retainer support mounted inside said container;

a single drive roller of uniform outside diameter attached to a first shaft rotatably and removably mounted to said first retainer support mounted inside said container;

a second retainer support mounted inside said container;

a single idler roller of uniform outside diameter attached to a second shaft rotatably and removably mounted to said second retainer support mounted inside said container, said ribbon being disposed between said rollers; and spring means for biasing said idler roller against said drive roller in order to facilitate gripping of said ribbon by said rollers, each of said retainer supports having a pair of stripping means attached thereto located above and below each of said rollers for stripping said ribbon from said rollers after said ribbon has been fed inside said container in order to facilitate folding of said ribbon into a plurality of folds, said ribbon feed mechanism having a predetermined distance between each of said retainer supports and said uniform outside diameter of a corresponding adjacent one of said rollers in order to further facilitate folding of said ribbon, said single drive and idler rollers of uniform outside diameter being adapted to grip said ribbon in order to provide increased pulling force on said ribbon.

2. The improved ribbon feed mechanism of claim 1 wherein said stripping means includes horizontal stripping portions attached to each of said retainer supports, said horizontal stripping portion shaving curved stripping guides attached thereto located between an outside diameter of a corresponding one of said rollers and a corresponding adjacent one of said shafts.

3. The improved ribbon feed mechanism of claim 2 wherein each of aid retainer supports has a vertical portion, said horizontal stripping portions of each of aid retainer supports extending horizontally from a corresponding one of said vertical portions, said predetermined distance existing between each of said vertical portions and each of said corresponding adjacent rollers.

4. The improved ribbon feed mechanism of claim 3 wherein said predetermined distance is about 0.05 inches.

5. The improved ribbon feed mechanism of claim 3 wherein each of said retainer supports has a pair of slotted expandable rings attached to a corresponding one of said vertical portions, each of said first and second shafts adapted to removably and rotatably engage a corresponding pair of said rings.

6. The improved ribbon feed mechanism of claim 3 wherein each of said rollers has a top surface and a bottom surface, said ribbon having a portion thereof extending above said top surfaces of said rollers and a portion extending below said bottom surfaces of said rollers to facilitate stripping of said ribbon from said rollers.

7. The improved ribbon feed mechanism of claim 6 wherein each of said horizontal stripping portions, said slotted expandable rings and said vertical portions are formed as integral parts of a corresponding one of said retainer supports.

8. An improved ribbon feed mechanism used to fold a printing ribbon inside a cartridge-type container and to move the ribbon for printing, comprising:

a first retainer support mounted inside said container;

a drive assembly rotatably and removably mounted to said first retainer support, said drive assembly including a single integral drive roller of uniform outside diameter;

a second retainer support mounted inside said container;

an idler assembly rotatably and removably mounted to said second retainer support mounted inside said container, said idler assembly including a single integral idler roller of uniform outside diameter, said ribbon passing between said drive and idler rollers;

spring means for biasing said idler roller against said drive roller in order to facilitate gripping of said ribbon by said rollers; and stripping means attached to each of said retainer supports for stripping said ribbon from said rollers and for reversing the direction of said ribbon after said ribbon has been fed inside said container in order to facilitate folding of said ribbon into a plurality of folds, said stripping means including a vertical portion and horizontal stripping portions attached to aid vertical portions, said horizontal stripping portions having curved stripping guides attached thereto, each pair of said horizontal stripping portions located above and below a corresponding one of said rollers, said ribbon feed mechanism having a predetermined distance between each of said vertical portions and said uniform outside diameter of a corresponding adjacent one of said rollers, said single drive and idler rollers of uniform outside diameter being adapted to grip said ribbon in order to provide increased pulling force on said ribbon.

9. The improved ribbon feed mechanism of claim 8 wherein each of said rollers is attached to a shaft removably and rotatably mounted to a corresponding one of said retainer supports, said curved stripping guides being located between an outside diameter of a corresponding one of said rollers and a corresponding one of said shafts.

10. The improved ribbon feed mechanism of claim 9 wherein said predetermined distance is about 0.05 inches.

11. The improved ribbon feed mechanism of claim 9 wherein each of said retainer supports has a pair of slotted expandable rings attached to a corresponding one of said vertical portions, each of said shafts capable of removably and rotatably engaging a corresponding pair of said rings.

12. The improved ribbon feed mechanism of claim 11 wherein each of said rollers has a top surface and a bottom surface, said ribbon having a portion thereof extending above said top surfaces and a portion thereof extending below said bottom surfaces when disposed between said rollers to facilitate stripping of said ribbon from said rollers.

13. The improved ribbon feed mechanism of claim 12 wherein each of said horizontal stripping portions, said slotted expandable rings and said vertical portions are formed as integral parts of a corresponding one of said retainer supports.

14. An improved ribbon feed mechanism used to fold a printing ribbon into a plurality of folds inside a cartridge-type container capable of being used for computer printing, dot matrix printing, typewriter printing, and other printing, comprising:

a single drive roller of uniform outside diameter attached to a first shaft, said first shaft having upper and lower extensions;

a first retainer support mounted inside said container, said first retainer support including a vertical portion and a pair of slotted expandable rings attached to said vertical portion, said upper and lower extensions of said first shaft removably and rotatably engaging said pair of slotted expandable rings so that said drive roller is disposed between and rotatably mounted between said pair of slotted expandable rings, said first retainer support further including a pair of horizontal stripping portions attached to said vertical support, said horizontal stripping portions having curved stripping guides attached thereto, said drive roller being disposed between said horizontal stripping portions;

a single idler roller of uniform outside diameter attached to a second shaft, said second shaft having upper and lower extensions;

a second retainer support mounted inside said container, said second retainer support including a vertical portion and a pair of slotted expandable rings attached to said vertical portion of said second retainer support, said upper and lower extensions of said second shaft removably and rotatably engaging said pair of slotted expandable rings of said second retainer support so that said idler roller is disposed between and rotatably mounted between said pair of slotted expandable rings of said second retainer support, said second retainer support further including a pair of horizontal stripping portions attached to said vertical support of said second retainer support, said horizontal stripping portions of said second retainer support having curved stripping guides attached thereto, said idler roller being disposed between said horizontal stripping portions of said second retainer support; and spring means for biasing said idler roller against said drive roller in order to facilitate gripping of said ribbon between said rollers, said ribbon feed mechanism having a predetermined distance between each of said vertical portions and said uniform outside diameter of a corresponding adjacent one of said rollers, said single drive and idler rollers of uniform outside diameter being adapted to grip said ribbon in order to provide increased pulling force on said ribbon.

15. The improved ribbon feed mechanism of claim 14 wherein said predetermined distance is about 0.05 inches.

16. The improved ribbon feed mechanism of claim 15 wherein said lower extension of said first shaft has a gear attached thereto and said upper extension of said first shaft has a turning knob attached thereto.

17. The improved ribbon feed mechanism of claim 16 wherein each of said horizontal stripping portions, said slotted expandable rings and said vertical portions are formed as integral parts of a corresponding one of said retainer supports.

* * * * *